US010427213B2

(12) United States Patent
Kasperski et al.

(10) Patent No.: US 10,427,213 B2
(45) Date of Patent: Oct. 1, 2019

(54) TURBINE BLADE WITH SECTIONED PINS AND METHOD OF MAKING SAME

(71) Applicant: General Electric Company, Schenectady, NY (US)

(72) Inventors: Tyler Walton Kasperski, Greenville, SC (US); Mark Andrew Jones, Ponte Vedra Beach, FL (US); Jason Adam Neville, Greenville, SC (US)

(73) Assignee: General Electric Company, Schenectady, NY (US)

( * ) Notice: Subject to any disclaimer, the term of this patent is extended or adjusted under 35 U.S.C. 154(b) by 313 days.

(21) Appl. No.: 15/432,055

(22) Filed: Feb. 14, 2017

(65) Prior Publication Data

US 2017/0152748 A1 Jun. 1, 2017

Related U.S. Application Data

(63) Continuation-in-part of application No. 13/955,679, filed on Jul. 31, 2013, now Pat. No. 9,695,696.

(51) Int. Cl.

| | |
|---|---|
| ***F01D 5/18*** | (2006.01) |
| ***B22C 9/10*** | (2006.01) |
| ***B22C 9/24*** | (2006.01) |

(52) U.S. Cl.

CPC ..... *B22C 9/10* (2013.01); *B22C 9/24* (2013.01); *F01D 5/187* (2013.01); *F05D 2240/304* (2013.01); *F05D 2240/305* (2013.01); *F05D 2240/306* (2013.01); *F05D 2250/18* (2013.01); *F05D 2260/2212* (2013.01); *F05D 2260/2214* (2013.01); *F05D 2260/22141* (2013.01); *Y10T 29/49337* (2015.01)

(58) Field of Classification Search

CPC .. F01D 5/187; F05D 2230/12; F05D 2230/13; F05D 2260/22141

See application file for complete search history.

(56) References Cited

U.S. PATENT DOCUMENTS

| | | | |
|---|---|---|---|
| 4,514,144 | A | 4/1985 | Lee |
| 4,515,523 | A | 5/1985 | North |
| 4,786,233 | A | 11/1988 | Shizuya |
| 5,356,265 | A | 10/1994 | Kercher |
| 5,403,156 | A | 4/1995 | Arness |
| 5,695,322 | A | 12/1997 | Jacobson |
| 6,290,462 | B1 | 9/2001 | Ishiguro |
| 6,607,356 | B2 | 8/2003 | Manning |
| 6,902,372 | B2 | 6/2005 | Liang |
| 6,974,308 | B2 | 12/2005 | Halfmann |
| 6,984,102 | B2 | 1/2006 | Bunker |
| 7,008,179 | B2 | 3/2006 | Rinck |
| 7,175,386 | B2 | 2/2007 | Cherolis |
| 7,186,084 | B2 | 3/2007 | Bunker |

(Continued)

*Primary Examiner* — Ninh H. Nguyen
(74) *Attorney, Agent, or Firm* — Frank A. Landgraff; Charlotte C. Wilson; James W. Pemrick

(57) ABSTRACT

A turbine blade includes pressure and suction surfaces connected to define an interior through which coolant is passable. First and second pedestal arrays, each include pedestals respectively coupled to radially outboard portions of respective interior faces of one of the pressure and suction surfaces. The pedestals of the first pedestal array are separated from and directly opposed to pedestals of the second pedestal array by gaps respectively defined therebetween.

25 Claims, 8 Drawing Sheets

(56) References Cited

U.S. PATENT DOCUMENTS

| | | | | |
|---|---|---|---|---|
| 7,438,527 | B2 | 10/2008 | Albert | |
| 7,465,154 | B2 | 12/2008 | Devore et al. | |
| 7,513,745 | B2 | 4/2009 | Abdel-Messeh | |
| 7,520,312 | B2 | 4/2009 | Memmen | |
| 7,544,044 | B1 | 6/2009 | Liang | |
| 7,686,580 | B2 | 3/2010 | Cunha | |
| 7,713,027 | B2 | 5/2010 | Cherolis | |
| 7,857,589 | B1 | 12/2010 | Liang | |
| 7,938,624 | B2 | 5/2011 | Tibbott | |
| 8,066,483 | B1 | 11/2011 | Liang | |
| 8,137,068 | B2 | 3/2012 | Surace | |
| 8,147,205 | B2 | 4/2012 | Digard Brou De Cuissart | |
| 8,172,505 | B2 * | 5/2012 | Fujimoto | F01D 5/187 415/115 |
| 8,206,108 | B2 | 6/2012 | Riahi | |
| 8,231,349 | B2 | 7/2012 | Naik | |
| 8,292,581 | B2 | 10/2012 | Poon | |
| 8,366,399 | B2 | 2/2013 | Allen-Bradley | |
| 8,403,626 | B2 | 3/2013 | Hasselqvist | |
| 8,419,365 | B2 | 4/2013 | Kizuka | |
| 8,876,484 | B2 | 11/2014 | Duong | |
| 9,017,027 | B2 * | 4/2015 | Campbell | F01D 5/183 416/97 R |
| 2006/0269408 | A1 | 11/2006 | Liang | |
| 2006/0285974 | A1 * | 12/2006 | Bunker | F01D 5/20 416/97 R |
| 2008/0286104 | A1 | 11/2008 | Liang | |
| 2012/0076660 | A1 | 3/2012 | Spangler | |
| 2012/0269648 | A1 | 10/2012 | Lee | |
| 2012/0328450 | A1 | 12/2012 | Spangler | |
| 2017/0009589 | A1 | 1/2017 | Gupta | |

* cited by examiner

TURBINE BLADE WITH SECTIONED PINS AND METHOD OF MAKING SAME

CROSS-REFERENCE TO RELATED PATENT APPLICATIONS

This application is a continuation-in-part of application Ser. No. 13/955,679, filed Jul. 31, 2013.

BACKGROUND OF THE INVENTION

The subject matter disclosed herein relates to turbine blades and, more particularly, to turbine blades with sectioned pins and a method for making the turbine blades with sectioned pins.

A turbine blade may be disposed in a turbine section of a gas turbine engine. The turbine blade may be installed as part of an array of turbine blades in one of multiple axially arranged stages of the turbine section. As each array aerodynamically interacts with combustion gases, the array rotates about a rotor extending through the turbine section and causes corresponding rotation of the rotor that can be used to drive a compressor and a load.

When tuning natural frequencies of a turbine blade, one can increase the frequency by increasing the stiffness of the blade and/or reducing the mass of the blade (or vice versa for reducing the frequency). However, since increasing stiffness usually involves adding mass, tuning can become challenging due to the competing nature of these tuning approaches.

BRIEF DESCRIPTION OF THE INVENTION

According to one aspect, a turbine blade includes a pressure surface and a suction surface connected to define an interior through which coolant is passable, and a first pedestal array and a second pedestal array. Each of the first and second pedestal arrays include pedestals respectively coupled to radially outboard portions of respective interior faces of one of the pressure and suction surfaces. The pedestals of the first pedestal array being separated from and directly opposed to pedestals of the second pedestal array by gaps respectively defined therebetween.

According to another aspect, a turbine blade has a pressure surface and a suction surface connected to define an interior through which a coolant is passable, and a first pedestal array and a second pedestal array. Each of the first and second pedestal arrays have extended pedestals respectively coupled to respective interior faces of one of the pressure and suction surfaces. The pedestals are respectively coupled to radially outboard portions of respective interior faces of one of the pressure and suction surfaces. The pedestals of the first pedestal array are separated from and directly opposed to pedestals of the second pedestal array by gaps respectively defined therebetween.

According to yet another aspect, a method of machining a turbine blade includes the step of cutting one or more pins or pedestals in the turbine blade. The cutting forms a gap between directly opposing sections of the one or more pins or pedestals. The cutting is performed by a tool, and the tool gains access to the one or more pins or pedestals through a cavity or a slot in an edge of the turbine blade. The edge may be a trailing edge of the turbine blade, and the cavity is a trailing edge cavity or the slot is a trailing edge slot. The edge may also be a leading edge of the turbine blade, and the cavity is a leading edge cavity or the slot is a leading edge slot. The cutting is performed by one electrical discharge machining (EDM), laser cutting, wire cutting, or grinding.

The pins may be racetrack pins, pedestals or any pressure to suction side connecting feature, excluding ribs. The cutting step may separate the racetrack pins or pedestals substantially into equal portions, with the gap located directly between the opposing equal portions. The pedestals may comprise one or more pedestals located in a trailing edge cavity or a leading edge cavity.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
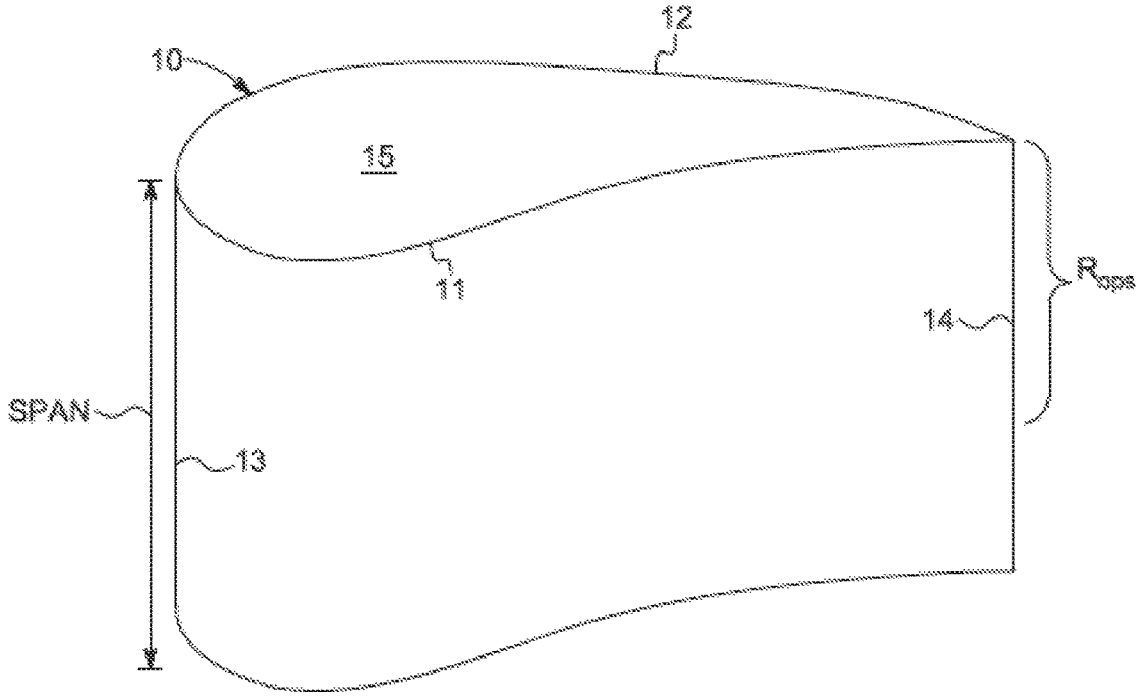
FIG. 1 is a schematic perspective view of a turbine blade.
Figure 2:
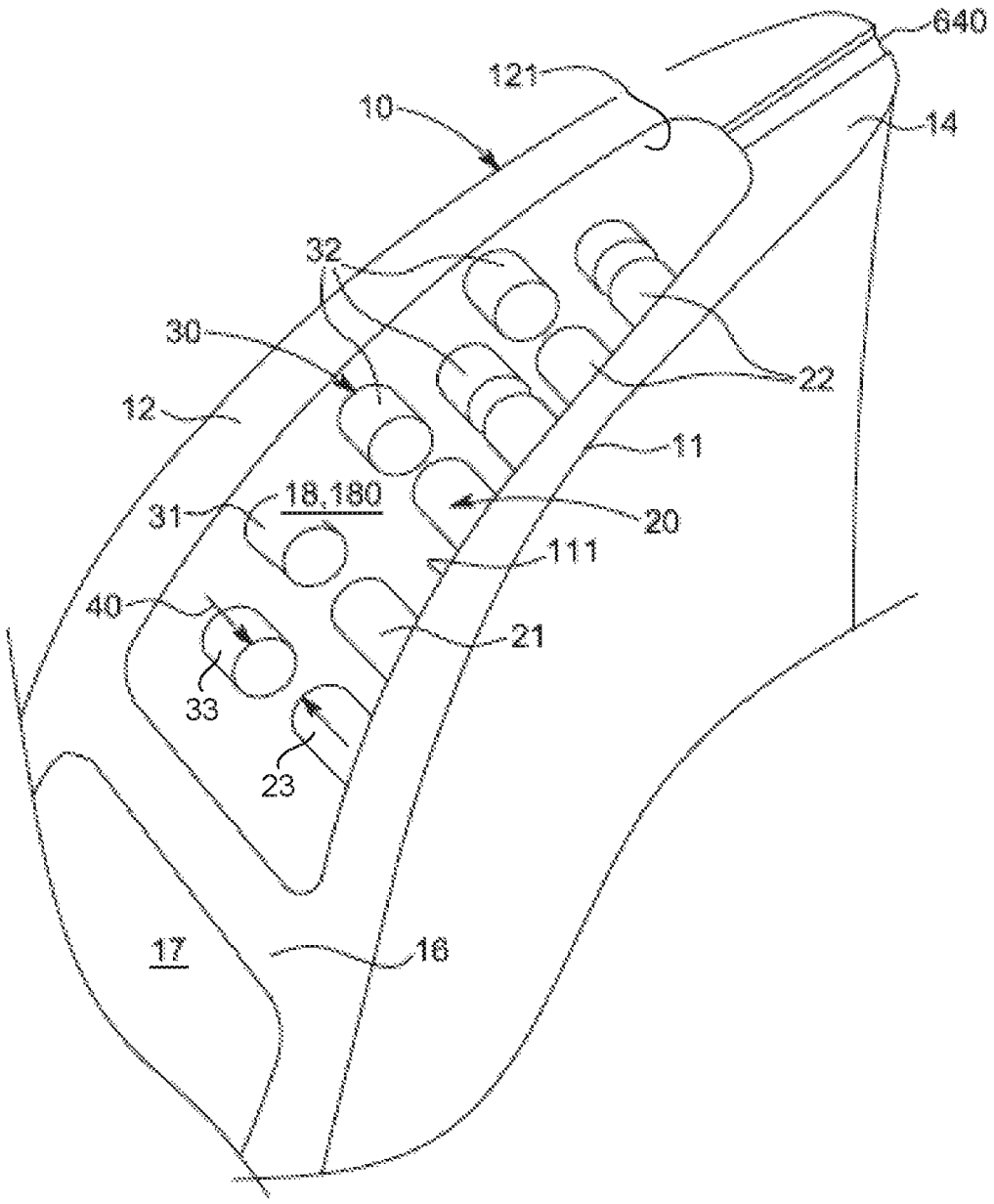
FIG. 2 is an enlarged perspective view of a trailing edge cavity of a turbine blade including sectioned pin banks in accordance with embodiments.

With reference to FIGS. 1 and 2, a turbine blade 10 is provided for use in, e.g., a gas turbine engine in which the turbine blade 10 is installed in a turbine section where combustion gases are expanded to produce work. The turbine blade 10 may be installed as part of an array of turbine blades in one of multiple axially arranged stages of the turbine section. As each array aerodynamically interacts with the combustion gases, the array rotates about a rotor extending through the turbine section. The rotation of the array causes corresponding rotation of the rotor that can be used to drive rotation of a compressor and a load (e.g., a generator).

The turbine blade 10 includes a pressure surface 11 and a suction surface 12 that are arranged oppositely with respect to one another. Both the pressure surface 11 and the suction surface 12 have a similar span that extends along a radial dimension of the rotor. The pressure surface 11 and the suction surface 12 may be connected to one another at a leading edge 13 and a trailing edge 14 such that they define an interior 15. The turbine blade 10 may further include baffles 16 (see FIG. 2) extending through the interior 15 along portions of the spans of the pressure surface 11 and the suction surface 12. The baffles 16 define pathways 17 or cavities 18 by which coolant can be directed and passed through the interior 15. The cavity 18 proximate to the trailing edge 14 will be referred to herein as a "trailing edge cavity" 180.

The turbine blade 10 further includes a first pedestal array 20 and a second pedestal array 30. The first pedestal array 20 includes a pedestal 21 coupled to at least a radially outboard portion of an interior face 111 of the pressure surface 11 in the trailing edge cavity 180. The second pedestal array 30 includes a pedestal 31 coupled to at least a radially outboard portion of an interior face 121 of the suction surface 12 in the trailing edge cavity 180. The pedestal 21 is directly opposed to the pedestal 31, and gap 40 is coaxial with pedestals 21 and 31. Likewise, pedestal 23 is directly opposed to the pedestal 33, and gap 40 is coaxial with pedestals 23 and 33. According to an aspect, each pedestal of the first pedestal array 20 is directly opposed to a corresponding pedestal of the second pedestal array. This occurs because the first and second pedestal arrays may be created by cutting pedestals (that extend continuously from face 111 to face 121) into two, and the "cut" forms gap 40. For example, pedestals 23 and 33 were one unitary pedestal (not shown) before cutting, and after the cutting process the single pedestal has now been formed into two pedestals 23 and 33 with the cut (or saw kerf) forming the gap between the two pedestals. As shown in FIG. 2, it is to be understood the pedestals 21, 22, 23 and 31, 32, 33 may be provided as a first plurality of pedestals 21, 22, 23 and as a second plurality of pedestals 31, 32, 33. For purposes of clarity and brevity, the case in which the pedestals 21, 22, 23 and 31, 32, 33 are provided as the first plurality of pedestals 21, 22, 23 and as the second plurality of pedestals 31, 32, 33 will be described below. It is also to be understood that the pedestals 21, 22, 23 and 31, 32, 33 need not be located only in the trailing edge cavity 180.

The radially outboard portion of the interior face 111 and the radially outboard portion of the interior face 121 are defined at a radially outboard portion $R_{OPS}$ of the span. Thus, in accordance with embodiments, the first plurality of pedestals 21, 22, 23 and the second plurality of pedestals 31, 32, 33 are provided at least at the radially outboard portion $R_{OPS}$ of the span (see FIG. 6). In accordance with further embodiments, however, the first plurality of pedestals 21, 22, 23 and the second plurality of pedestals 31, 32, 33 may be provided along the entirety of the span.

Each individual pedestal of the first pedestal array 20 may, but is not required to, correspond in location to, and be directly opposed to, a corresponding individual pedestal of the second pedestal array 30. That is, in accordance with alternative embodiments, the individual pedestals of the first pedestal array 20 may be misaligned with respect to the individual pedestals of the second pedestal array 30. In addition, each individual pedestal of the first pedestal array 20 may be separated by a gap 40 from one or more of the individual pedestals in the second pedestal array 30. As shown in FIG. 2, since a gap 40 is provided for at least pairs of individual pedestals 21, 22, 23 and 31, 32, 33 the turbine blade 10 is provided with multiple gaps 40.

In accordance with embodiments, the gap 40 may be about 0.04 inches wide although this is not required and embodiments exist in which the gap 40 is wider or narrower and where the size of the gap 40 varies. As nonlimiting examples, the gap 40 may range between about 0.001 inches to the local distance between interior faces 121 and 111. However, distances (or gaps) below or above this range may be utilized as desired in the specific application. Relative terms, such as "about" are defined to have a tolerance of 20%, unless otherwise specified. More generally, the gap 40 is larger than any gap that would normally be found in a conventional turbine blade as a result of manufacturing tolerances resulting from the shape and size of the conventional ceramic core and the injection molding or casting of the conventional pressure and suction sides. Further, gap 40 may have varying widths between different pedestals. As examples only, gap 40 between pedestals 21 and 31 may be about 0.0001 inches, gap 40 between pedestals 22 and 32 may be about 0.001 inches and gap 40 between pedestals 23 and 33 may be about 0.04 inches.

In accordance with further embodiments, the interior 15 of the turbine blade 10 may be but is not required to be devoid of a pin that extends along an entirety of the distance between the interior face 111 of the pressure surface 11 and the interior face 121 of the suction surfaces 12 (i.e., the turbine blade 10 may be configured such that it does not include "fully elongated" pins). However, where the turbine blade 10 does include fully elongated pins, the baffles 16 may be distinguished from such fully elongate pins in that the baffles 16 extend along a substantial length of the spans of the pressure and suction surfaces 11 and 12 and thereby define the overall shapes and sizes of the pathways 17, the cavities 18 generally and the trailing edge cavity 180 particularly. Aspects of the present invention may be applicable to any pressure side/surface to suction side/surface connecting feature, with the exception to a baffle/rib. The baffles (or impingement ribs) 16 are separate features from the pedestals, and the baffles are not modified in any way.

Figure 3:
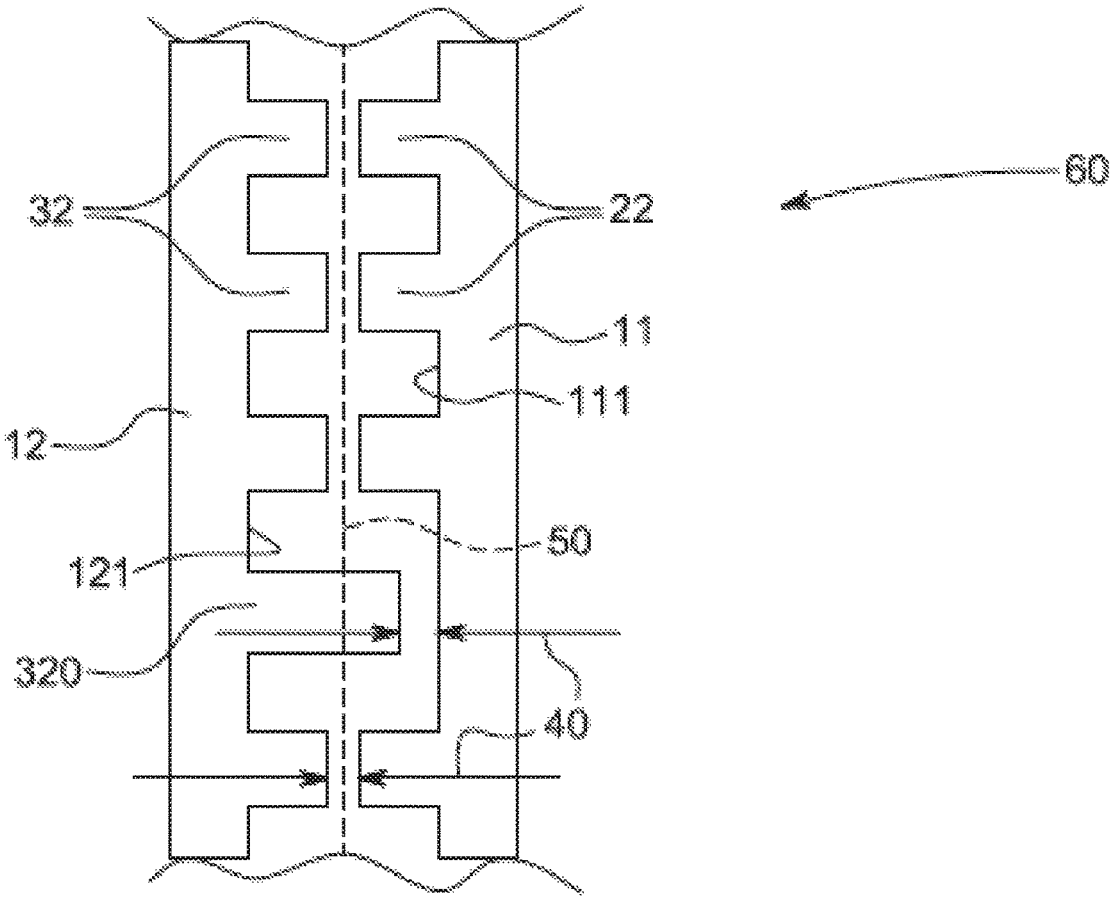
FIG. 3 is a schematic view of gaps formed between pedestals of sectional pin banks in accordance with embodiments.
Figure 4:
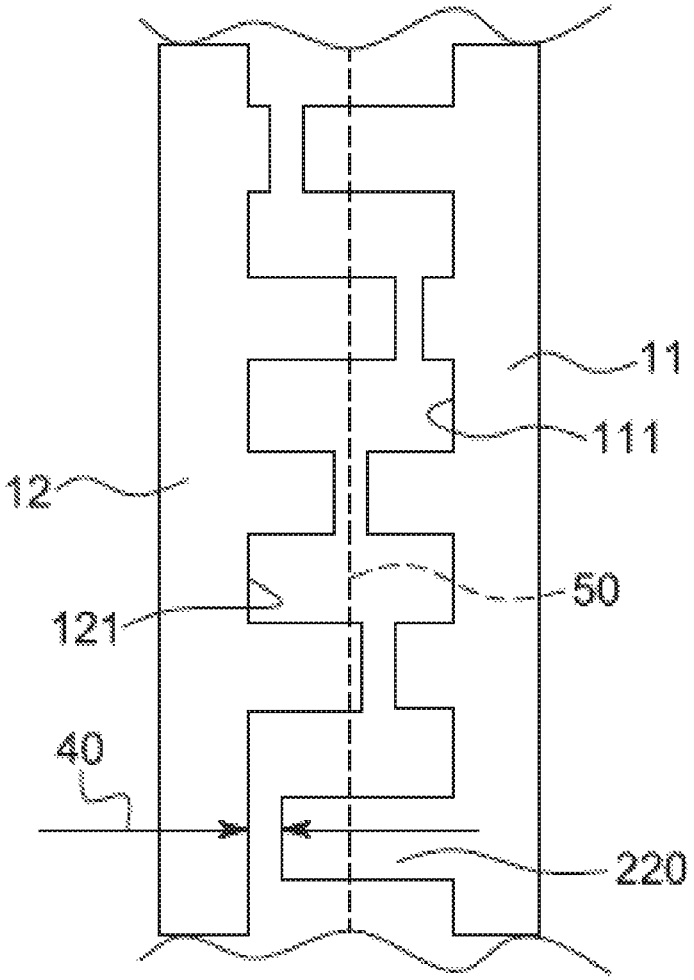
FIG. 4 is a schematic view of staggered gaps formed between pedestals of sectional pin banks in accordance with embodiments.
Figure 5:
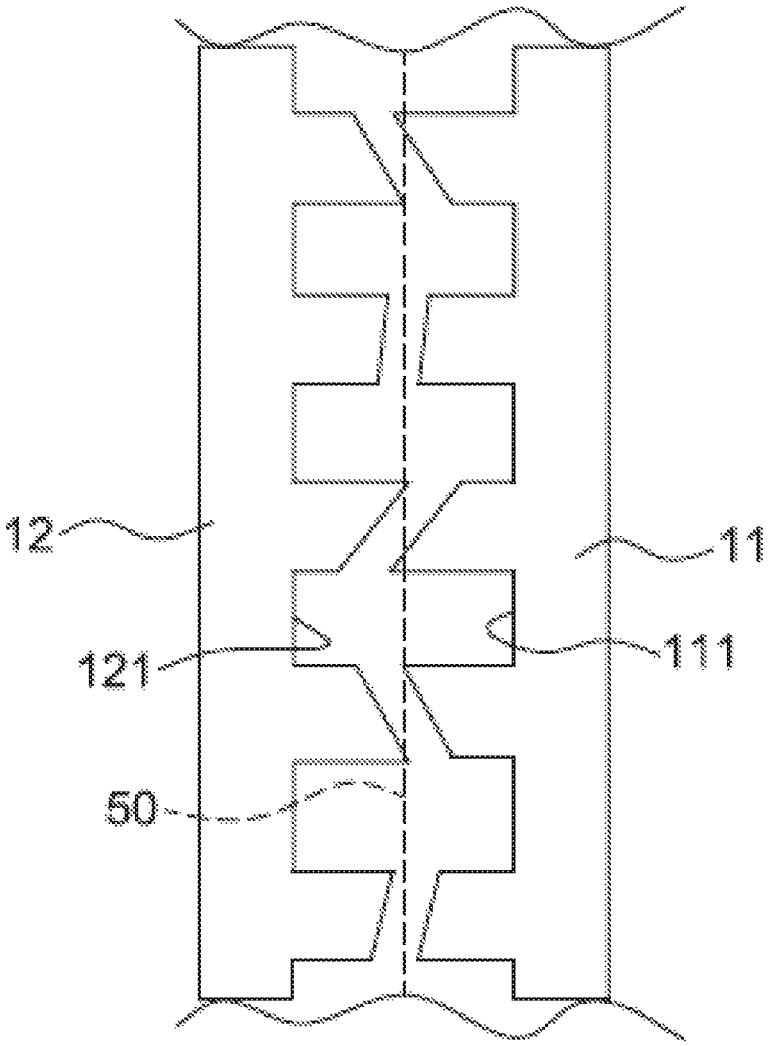
FIG. 5 is a schematic view of non-parallel gaps formed between pedestals of sectional pin banks in accordance with embodiments.

With reference to FIGS. 3-5, various embodiments will now be described. As shown in FIG. 3, all or a portion of the gaps 40 may be defined along a mean camber line 50 of the turbine blade 10 where the mean camber line 50 is cooperatively defined by the respective shapes of the pressure and suction surfaces 11 and 12. Alternatively, although not shown in FIG. 3, it is to be understood that all or a portion of the gaps 40 may be defined on one side of the mean camber line 50. As shown in FIG. 4, all or a portion of the gaps 40 may be defined on both sides of or along the mean camber line 50. In these embodiments, all or a portion of adjacent gaps 40 may be defined on opposite sides of the mean camber line 50. Alternatively, a distribution of all or a portion of the gaps 40 may be defined on each side of the mean camber line 50 at random. As shown in FIGS. 3 and 4, all or a portion of the gaps 40 may be defined in parallel with the mean camber line 50. Alternatively, as shown in FIG. 5, all or a portion of the gaps 40 may be oriented transversely or non-parallel with respect to the mean camber line 50.

In addition, as shown in FIGS. 3 and 4, individual extended pedestals 220, 320 may be respectively coupled to the respective interior faces 111, 121 of the pressure and suction surfaces 11 and 12. The individual extended pedestals 220, 320 are distinguished from the individual pedestals 22 and 32 in that the individual extended pedestals 220 extend from the interior face 111 and are separated from the interior face 121 by corresponding gaps 40 while the individual extended pedestals 320 extend from the interior face 121 and are separated from the interior face 111 by corresponding gaps 40.

In each case, the embodiments of FIGS. 3-5 may be provided alone or in various combinations with one another. Generally, the size, shape and orientation of the individual pedestals 22 and 32 and the gaps 40 may be provided in accordance with various design considerations of the turbine blade 10. For example, when tuning natural frequencies of a turbine blade, one can increase the frequency by increasing the stiffness of the blade and/or reducing the mass of the blade (vice versa for reducing the frequency). However, since increased stiffness may involve adding mass, tuning can become challenging due to the competing nature of these tuning effects. That is, the frequency of a blade with trailing edge motion can be altered if the stiffness could be affected without appreciably impacting the mass. This can be accomplished in accordance with the embodiments described herein. By providing the gaps 40 between the individual pedestals 22 and 32 (i.e., by separating the individual pedestals 22 and 32), the pressure side of the turbine blade 10 can be decoupled from the suction side and stiffness can be reduced. However, by maintaining the individual pedestals 22 and 32 and making the gaps 40 relatively small, the mass of the turbine blade 10 is negligibly affected.

In accordance with further aspects of the invention, the size, shape and orientation of the individual pedestals 22 and 32 and the gaps 40 may be provided in accordance with various particular design considerations of the turbine blade 10. For example, more effectively cooling relatively hotter regions on the pressure surface 11 or the suction surface 12 may be accomplished by the provision of longer individual pedestals 22 proximate to the hotter region, thus enhancing the fin effectiveness in that region.

Figure 6:
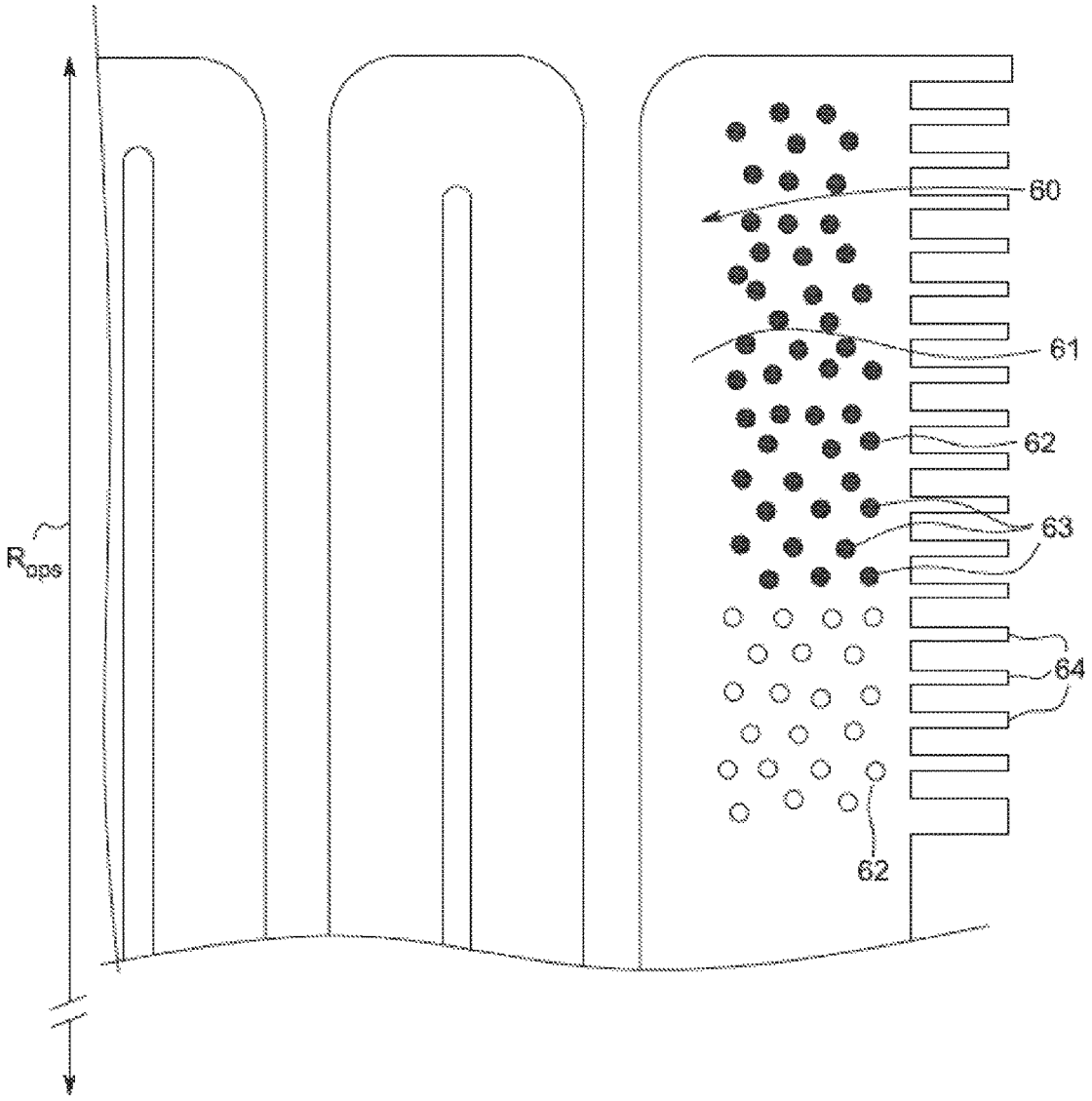
FIG. 6 is a perspective view of a ceramic core in accordance with embodiments.

With reference to FIG. 6, a method of forming the turbine blade 10 will now be described. The method includes creating a ceramic core 60 that can be used to form the trailing edge cavity 180. As shown in FIG. 6, the ceramic core 60 includes an elongate element 61 having pin forming recesses 62 and gap forming core portions 63 at least at the radially outboard portion $R_{OPS}$ of the span. The gap forming core portions 63 are disposed between the pedestal forming recesses 62 such that the individual pedestals 21 and 31 will be separate from one another. The elongate element 61 further includes trailing edge hole forming portions 64, which are arrayed along a side of the elongate element 61 to be used to form trailing edge holes 640 in the turbine blade (see FIG. 2).

Once the ceramic core 60 is created, the method further includes casting (or another similar manufacturing method or process) of pressure and suction sides of the turbine blade 10 on either side of the elongate element 61 such that the pressure and suction sides include the above-described individual pedestals 22 and 32 formed in the pedestal forming recesses 62 and assembling the pressure and suction sides of the turbine blade 10 together such that the pressure side individual pedestals 22 are separated from the suction side individual pedestals 32 by the gaps 40 having dimensions similar to the gap forming core portions 63.

Although the method as described above relates to cast components, it is to be understood that this is not required and that other manufacturing methods and processes may be employed for other types of components. For example, the individual pedestals 22 and 32 may be formed in part that is assembled or fabricated. Such a part may be provided as buckets, blades, nozzles or any other gas turbine components. In existing components (such as a new or used blade), the pedestals may be cut by a machining process (e.g., electrical discharge machining (EDM), laser cutting, wire cutting, grinding or other suitable machining material removal process). The machining process will result in a single pedestal being cut into two separate and directly opposing pedestals, and this may be repeated for multiple cutting operations on a plurality of pedestals. The gap formed between opposing pedestals may be equal to (or greater than) the width of the cutting implement. If an electrode is used to cut the pedestals or racetrack pins, then the resulting gap would be at least the set width of the electrode which may be about 0.001 inches wide to the local distance between interior faces 111 and 121. Wider gaps could be obtained by multiple cutting operations on the same pair of resulting pedestals.

Figure 7:
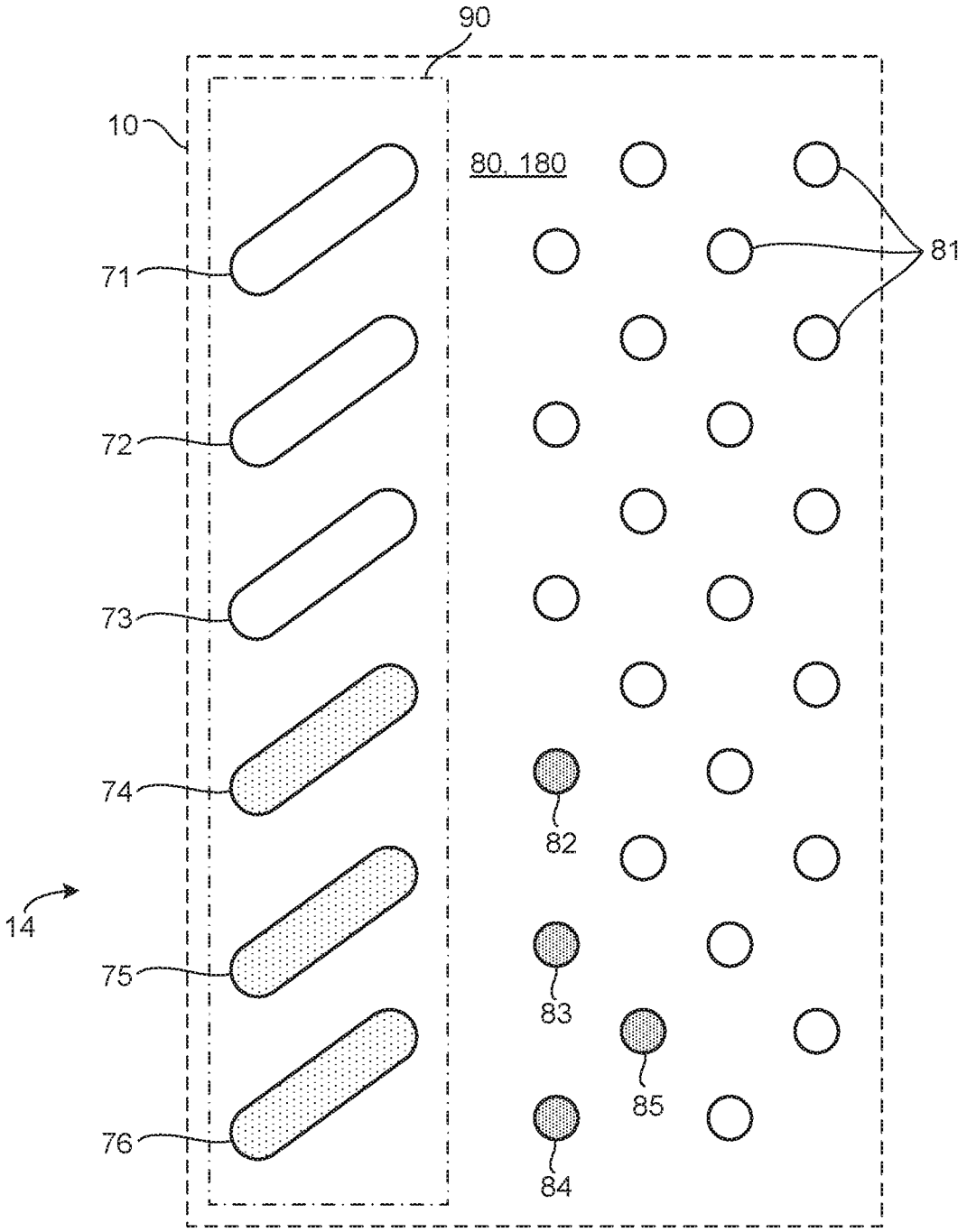
FIG. 7 illustrates a partial cross-sectional view of the racetrack pins and pedestals/pins in a blade, in accordance with embodiments.

FIG. 7 illustrates a partial cross-sectional view of the racetrack pins 71-76 and pedestals/pins 81 in a blade 10, in accordance with embodiments. The racetrack shaped pins 71, 72, 73, 74, 75, 76 are located near a trailing edge 14 of blade 10. The racetrack pins 71-76 are elongated pins (with an outer perimeter shaped somewhat like a standard shaped oval racetrack), and may replace or be located in or near trailing edge holes 640 or a trailing edge slot 90 of blade 10. Trailing edge slot 90 may also be referred to as a trailing edge cavity. Pedestals 81 are located further inward in cavity 80, 180, when compared to racetrack pins 71-76.

Figure 8:
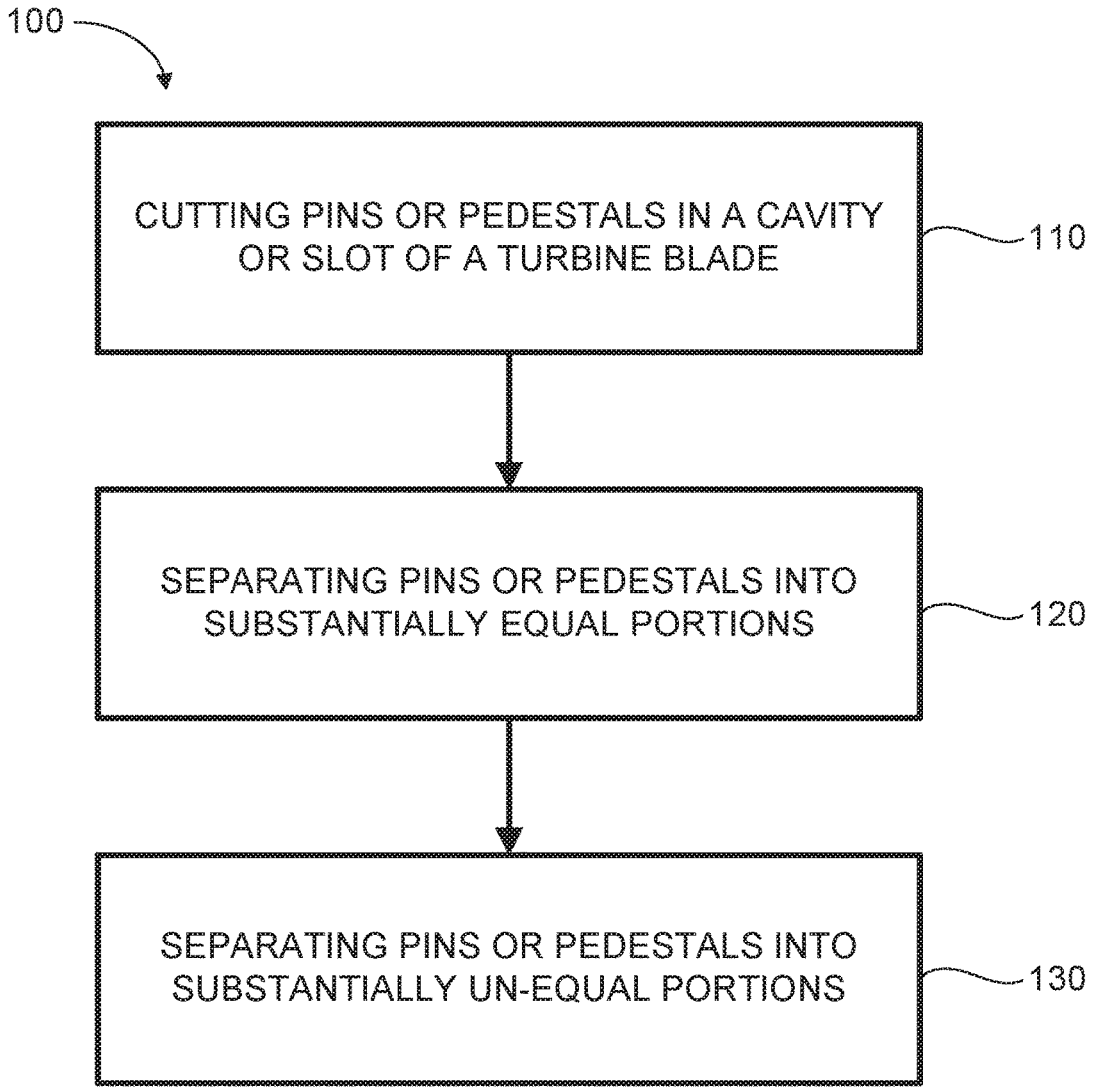
FIG. 8 illustrates a method for machining a turbine blade, in accordance with embodiments.

FIG. 8 illustrates a method 100 for machining a turbine blade, in accordance with embodiments. In step 110 one or more pins or pedestals in the turbine blade are cut. The cutting forms a gap between directly opposing sections of the one or more pins or pedestals. For example, a pedestal (or pin) that extends from one interior wall to an opposing interior wall is cut into two directly opposing sections, and these two sections are separated by a gap. The cutting is performed by a tool, and the tool gains access to the one or more pins or pedestals through a cavity or a slot in an edge of the turbine blade. The edge may be a trailing edge of the turbine blade, and in this case the cavity is a trailing edge cavity or the slot is a trailing edge slot 90. Alternatively, the edge may be a leading edge of the turbine blade, and in this case the cavity is a leading edge cavity or the slot is a leading edge slot.

An optional step 120, separates the pins or pedestals into substantially equal portions or halves. For example, a racetrack pin (originally 0.03 inches thick) would be cut in half so that a first half may be 0.01 inches thick, an intervening gap may be 0.01 inches wide and the second and opposing half may be 0.01 inches thick. A similar process could be used for pins located in an internal cavity (such as a trailing edge cavity or a leading edge cavity). Another optional step 130 separates the pins or pedestals into substantially unequal portions. For example, a pin (originally 0.05 inches long) would be separated into a first portion 0.01 inches long, a gap 0.01 inches wide and a second portion being 0.03 inches long.

Referring back to FIG. 7, the racetrack pins 74, 75 and 76 are cut substantially in half. Racetrack pin 74 now comprises two substantially equally sized portions (e.g., 74*a* and 74*b*, not shown) with a gap formed therebetween by the cutting process. The process is repeated for racetrack pins 75 and 76. It is to be understood that pins 74-76 could be cut into un-equal portions as well, if desired in the specific application. With slots formed in racetrack pins 74-76, additional interior pins/pedestals may be cut. For example, pedestals 82, 83, 84 and 85 may be cut so that a gap is formed between directly opposing portions of the pedestals. As a non-limiting example only, pedestals 82 and 83 may be cut into two equal portions, so that a gap exists therebetween each opposing pedestal portion. Pedestal 84 may be cut into two un-equal portions, so that a gap exists on a suction side of a mean camber line. Pedestal 85 may also be cut into two un-equal portions, but the gap exists on a pressure side of a mean camber line. The remaining pedestals may remain uncut, if desired. As stated previously, the gaps 40 may be located on the mean camber line, on a suction side of the mean camber line, on a pressure side of the mean camber line, or any combination of the previous locations, or on just one on the previous locations. The locations of gaps 40 will be driven by the tuning requirements for the specific blade.

As described herein, a manufacturing process of the ceramic core 60 may be simplified as compared to conventional processes. In accordance with the embodiments described herein, the ceramic core 60 is created such that the gaps 40 are formed directly and preserved. Core yield may be thereby improved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine blade, comprising:

a pressure surface and a suction surface connected to define an interior through which coolant is passable; and a first pedestal array and a second pedestal array, each of the first and second pedestal arrays including pedestals respectively coupled to radially outboard portions of respective interior faces of one of the pressure and suction surfaces, the pedestals of the first pedestal array being separated from and directly opposed to pedestals of the second pedestal array by gaps respectively defined therebetween; and wherein the gaps are respectively defined on one side of a camber line of the turbine blade.

2. The turbine blade according to claim 1, wherein the pedestals of the first pedestal array are respectively coupled to portions of the interior face of the pressure surface along a radial portion of the turbine blade and the pedestals of the second pedestal array are respectively coupled to portions of the interior face of the suction surface along the radial portion of the turbine blade.

3. The turbine blade according to claim 1, wherein the gaps are about 0.01 inches to about 0.1 inches wide.

4. The turbine blade according to claim 1, wherein the gaps are respectively defined along a camber line of the turbine blade.

5. The turbine blade according to claim 1, wherein the gaps are respectively defined in parallel with a camber line of the turbine blade.

6. The turbine blade according to claim 1, wherein the gaps are respectively oriented transversely or non-parallel with respect to a camber line of the turbine blade.

7. A turbine blade, comprising:

a pressure surface and a suction surface connected to define an interior through which a coolant is passable; and a first pedestal array and a second pedestal array, each of the first and second pedestal arrays including:

extended pedestals respectively coupled to respective interior faces of one of the pressure and suction surfaces; and pedestals respectively coupled to radially outboard portions of respective interior faces of one of the pressure and suction surfaces, the pedestals of the first pedestal array being separated from and directly opposed to pedestals of the second pedestal array by gaps respectively defined therebetween; and wherein the gaps are respectively defined on one side of a camber line of the turbine blade, or adjacent gaps are respectively defined on opposite sides of the camber line and a distribution of gaps respectively defined on each side of the camber line is random.

8. The turbine blade according to claim 7, wherein the pedestals of the first pedestal array are respectively coupled to portions of the interior face of the pressure surface along an entire span of the turbine blade and the pedestals of the second pedestal array are respectively coupled to portions of the interior face of the suction surface along the entire span of the turbine blade.

9. The turbine blade according to claim 7, wherein the gaps are respectively defined in parallel with a camber line of the turbine blade.

10. The turbine blade according to claim 7, wherein the gaps are respectively oriented transversely or non-parallel with respect to a camber line of the turbine blade.

11. A method of machining a turbine blade, comprising:

cutting one or more pins or pedestals in the turbine blade, the cutting forming a gap between directly opposing sections of the one or more pins or pedestals; and wherein the cutting is performed by a tool, and the tool gains access to the one or more pins or pedestals through a cavity or a slot in an edge of the turbine blade.

12. The method of claim 11, wherein the edge is a trailing edge of the turbine blade, and the cavity is a trailing edge cavity or the slot is a trailing edge slot.

13. The method of claim 11, wherein the edge is a leading edge of the turbine blade, and the cavity is a leading edge cavity or the slot is a leading edge slot.

14. The method of claim 11, the cutting performed by one of:

electrical discharge machining (EDM), laser cutting, wire cutting, or grinding.

15. The method of claim 11, the one or more pins comprising one or more racetrack pins.

16. The method of claim 15, the cutting separating the one or more racetrack pins substantially into equal portions, with the gap located directly between the opposing equal portions.

17. The method of claim 11, the one or more pedestals comprising one or more pedestals located in a trailing edge cavity or a leading edge cavity.

18. The method of claim 17, the cutting separating the one or more pedestals into substantially equal portions, with the gap located directly between the opposing equal portions.

19. A turbine blade, comprising:

a pressure surface and a suction surface connected to define an interior through which coolant is passable; and a first pedestal array and a second pedestal array, each of the first and second pedestal arrays including pedestals respectively coupled to radially outboard portions of respective interior faces of one of the pressure and suction surfaces, the pedestals of the first pedestal array being separated from and directly opposed to pedestals of the second pedestal array by gaps respectively defined therebetween; and wherein the gaps are respectively defined on both sides of or along a camber line of the turbine blade, and a distribution of gaps respectively defined on each side of the camber line is random.

20. The turbine blade according to claim 19, wherein the pedestals of the first pedestal array are respectively coupled to portions of the interior face of the pressure surface along a radial portion of the turbine blade and the pedestals of the second pedestal array are respectively coupled to portions of the interior face of the suction surface along the radial portion of the turbine blade.

21. The turbine blade according to claim 19, wherein the gaps are about 0.01 inches to about 0.1 inches wide.

22. The turbine blade according to claim 19, wherein at least some of the gaps are respectively defined along a camber line of the turbine blade.

23. The turbine blade according to claim 19, wherein adjacent gaps are respectively defined on opposite sides of the camber line.

24. The turbine blade according to claim 19, wherein the gaps are respectively defined in parallel with a camber line of the turbine blade.

25. The turbine blade according to claim 19, wherein the gaps are respectively oriented transversely or non-parallel with respect to a camber line of the turbine blade.

* * * * *